US006397002B1

(12) United States Patent
Bucher et al.

(10) Patent No.: US 6,397,002 B1
(45) Date of Patent: May 28, 2002

(54) COMBINATION FAN AND HEATER

(75) Inventors: John C. Bucher, Ft. Lauderdale; Charles E. Bucher, Valrico, both of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/724,278

(22) Filed: Nov. 28, 2000

(51) Int. Cl.[7] ..... F24H 3/00; F24D 13/00
(52) U.S. Cl. ..... 392/368; 392/361
(58) Field of Search ..... 392/368, 361, 392/365, 366–369, 360–364; 34/96–97

(56) References Cited

U.S. PATENT DOCUMENTS

| | | | | | |
|---|---|---|---|---|---|
| 1,313,258 | A | * | 8/1919 | Carmean | 392/365 |
| 1,611,049 | A | * | 12/1926 | Lassonde | 392/365 |
| 1,714,167 | A | * | 5/1929 | Hardin | 392/361 |
| 1,998,670 | A | * | 4/1935 | Goshorn | 392/365 |
| 2,120,795 | A | * | 6/1938 | Boothby | 392/365 |
| 2,415,621 | A | * | 2/1947 | Arnhym | 392/365 |
| 2,473,325 | A | * | 6/1949 | Aufiero | 392/361 |
| 2,694,136 | A | * | 11/1954 | Smith | 392/365 |
| 2,839,657 | A | * | 6/1958 | Mast | 392/365 |

FOREIGN PATENT DOCUMENTS

| | | | | |
|---|---|---|---|---|
| AU | 167256 | * | 3/1956 | 392/361 |
| GB | 2174279 | * | 10/1986 | 392/361 |

* cited by examiner

*Primary Examiner*—John A. Jeffery
(74) *Attorney, Agent, or Firm*—Holland & Knight LLP

(57) ABSTRACT

A combination fan and heater with fan speed control operates to provide a cooling or heated flow of air at various desired temperatures and airflow speeds. A switch controls the operation of a heating assembly and a motor, to operate at a higher speed when the device is used as a cooling fan, and at a lower speed when the device is used as a heater. A baffle is included in the heating assembly to concentrate air flow in the center of a fan blade assembly, so that only a portion of the airflow produced by the fan blade assembly actually flows through the heating assembly.

3 Claims, 5 Drawing Sheets

| CAPACITOR | POS. | MODE |
|---|---|---|
| | A | OFF |
| 2μf | B | FAN LOW |
| 1μf | C | FAN MED. |
| | D | FAN HIGH |
| 4μf | E | FAN / HEATER LOW |
| 3μf | F | FAN / HEATER HIGH |

COMBINATION FAN AND HEATER

BACKGROUND OF THE INVENTION

1. Field of the Invention

This invention relates to fans and to heaters. More particularly, this invention relates to integrated fans and heaters that may alternatively be used as a fan or a heater.

2. Description of the Background Art

Presently, there exists a variety of fans designed for creating a flow of circulating air in a room or other space. Typical fans comprise a rotating fan blade assembly, powered by an electric motor, mounted within a housing having a front and rear grill or cage. Upon rotation of the fan blade assembly, air is drawn from the rear of the housing through the rear grill and is forcibly propelled out the grill on the front of the housing, thereby creating a cooling flow of circulation in a room.

There also presently exist many types of heaters. Similar to fans, most conventional heaters comprise a rotating fan blade assembly, powered by an electric motor, mounted within a housing having a front and rear grill or cage. One or more heating elements are positioned within the housing, usually forwardly of the fan blade assembly. Upon rotation of the fan blade assembly, air is drawn from the rear of the housing through heating elements to heat the flow of air passing therethrough. The flow of heated air is then forcibly propelled out the grill on the front of the housing, thereby creating a flow of heated air in a room.

Obviously, cooling fans and heaters are in wide use. Most households usually have both—a cooling fan to be used during summer months and a heater to be used during winter months. Unfortunately, this requires purchasing both units. Moreover, while one is being used, the other one is typically placed in storage. Further, during the months of Spring or Fall, there are many days where the cooling fan is used during the warm daylight hours and the heater is needed during cooler nighttime hours. During these occasions, both the conventional cooling fan and the heater must be kept out, ready for use, thereby wastefully decreasing floor space and otherwise "cluttering" the room.

There presently exists a need for a combined cooling fan and heater that integrates the functionality cooling fans and heaters by creating a cooling flow of circulation during summer months and by creating a flow of heated air during winter months.

Therefore, it is an object of this invention to provide an improvement which overcomes the aforementioned inadequacies of the prior art cooling fan and heater art and provides an improvement which is a significant contribution to the advancement of the cooling fan and heater art.

Another object of this invention is to provide a combined cooling fan and heater that may function to provide a cooling flow of air or a heated flow of air.

Another object of this invention is to provide a combined cooling fan and heater that may function to provide a heated flow of air of various desired temperatures and air flow speeds.

Another object of this invention is to provide a combined cooling fan and heater comprising a fan blade assembly powered by a motor mounted within a housing, a heating assembly mounted rearwardly of said fan blade assembly and a switch for controlling the operation of said heating assembly and the motor to operate at a higher speed when used as a cooling fan and a lower speed when used as a heater.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention are set forth in the detailed description of the preferred embodiment in addition to the scope of the invention defined by the claims taken in conjunction with the accompanying drawings.

SUMMARY OF THE INVENTION

For the purpose of summarizing this invention, this invention comprises a combined cooling fan and heater. More particularly, the combination cooling fan and heater of the invention comprises a fan blade assembly rotatably mounted within a housing. In the preferred embodiment, the housing may simply comprise a wire cage supported by a floor stand. A motor is operatively connected to the fan blade assembly to cause rotation thereof. A motor control is provided for controlling the rotational speed of the motor and thus the rotational speed of the fan blade assembly. A heater assembly is positioned rearwardly of the fan blade assembly such that a portion of the air flowing through the fan blade assembly flows through the heating assembly.

An important feature of the combination cooling fan and heater of the invention is the positioning and design of the heating assembly of the fan blade assembly. Specifically, most resistive heating elements, such as ones employed in heating assembly of the subject invention, operate either on or off. Thus, resistive heating elements produce a fixed amount of heat. Too fast of airflow through the heating assembly would result in the airflow feeling too cool and therefore not warm even though the same amount of heat is being generated. Conversely, too slow of airflow through the heating assembly would result in the airflow feeling too hot. By positioning the heating assembly rearwardly of the fan blade assembly, only a portion of the airflow produced by the fan blade assembly actually flows through the heating assembly. By sizing the wattage and the number of resistive elements of the heating assembly relative to the amount of air flowing through the heating assembly at different fan speeds, the temperature of the airflow can be precisely controlled. The temperature of the airflow can be adjusted during use to provide the desired amount of heating without feeling too cold or too hot.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
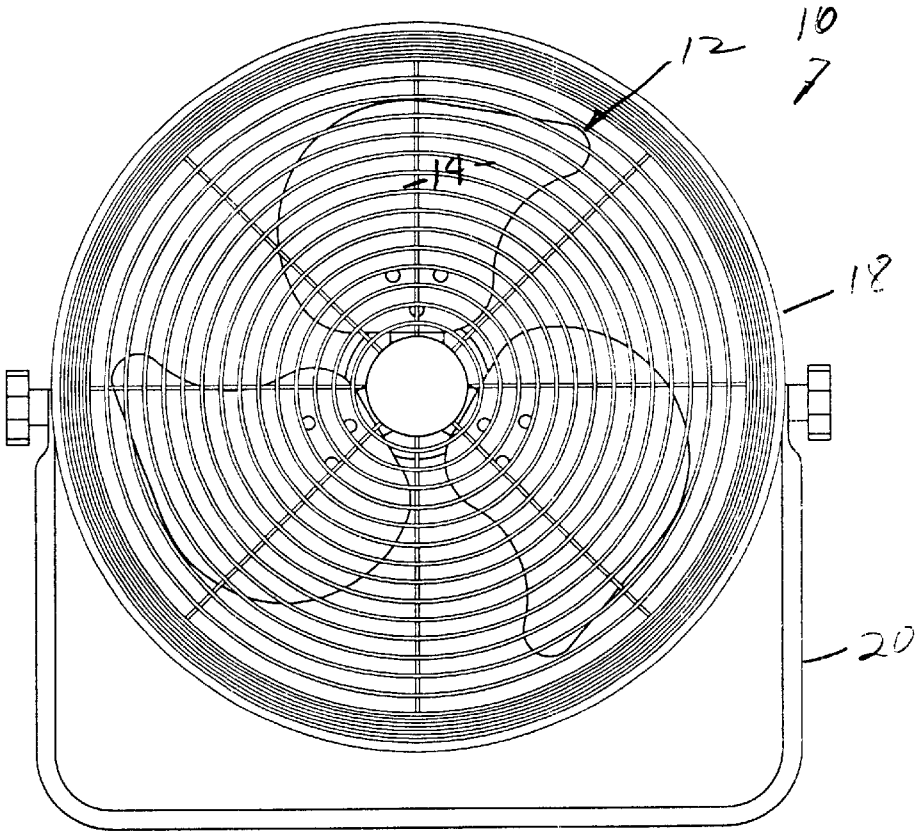
FIG. 1 is a front elevational view of the combination cooling fan and heater of the invention.
Figure 2:
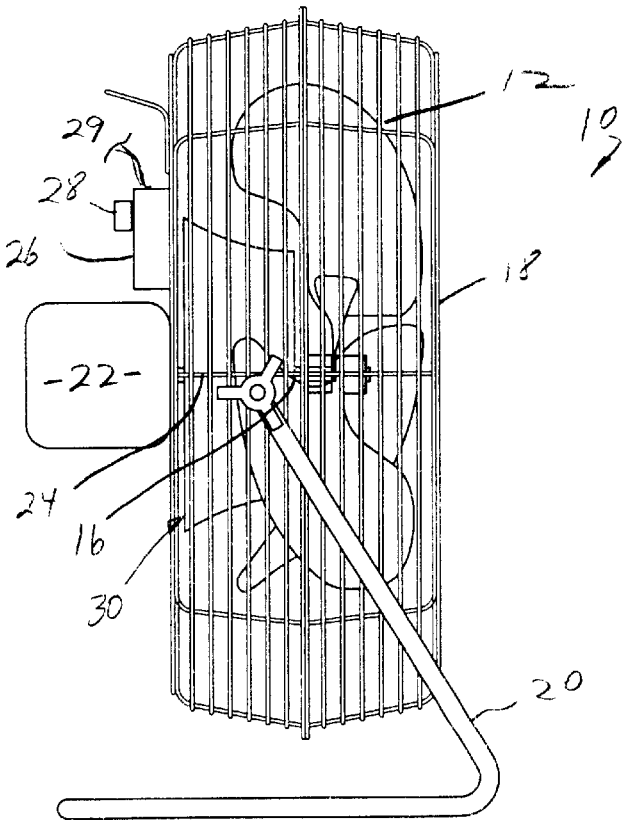
FIG. 2 is a side elevational view thereof.
Figure 3:
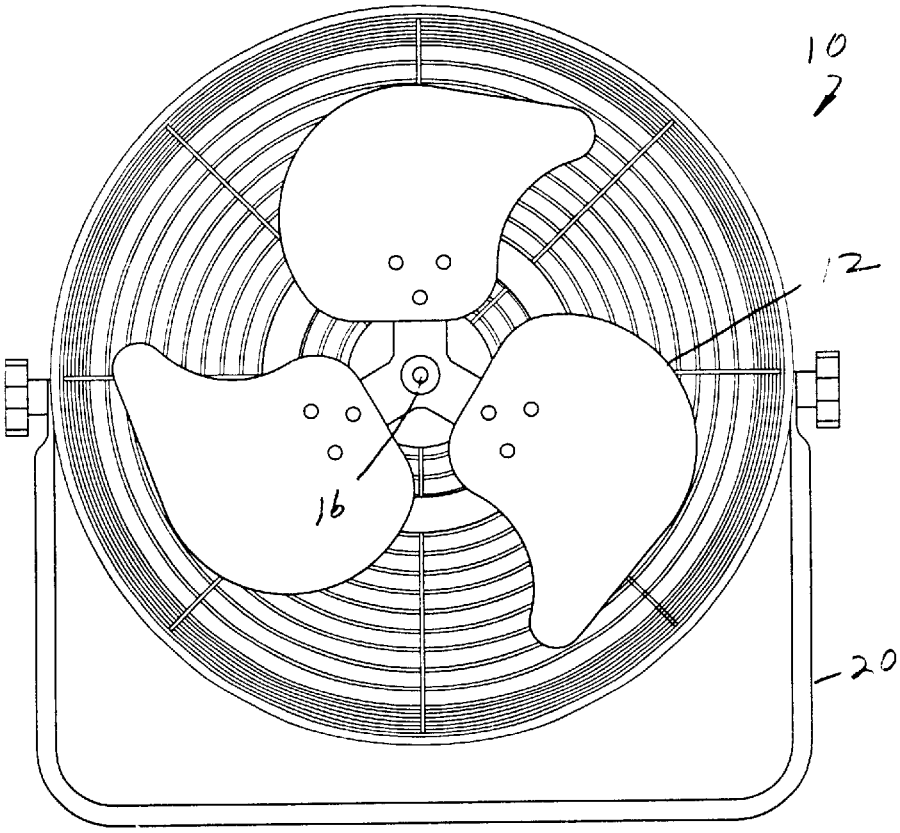
FIG. 3 is a front elevational view of the combination cooling fan and heater of the invention with the front of the cages removed for clarity in illustration.
Figure 4:
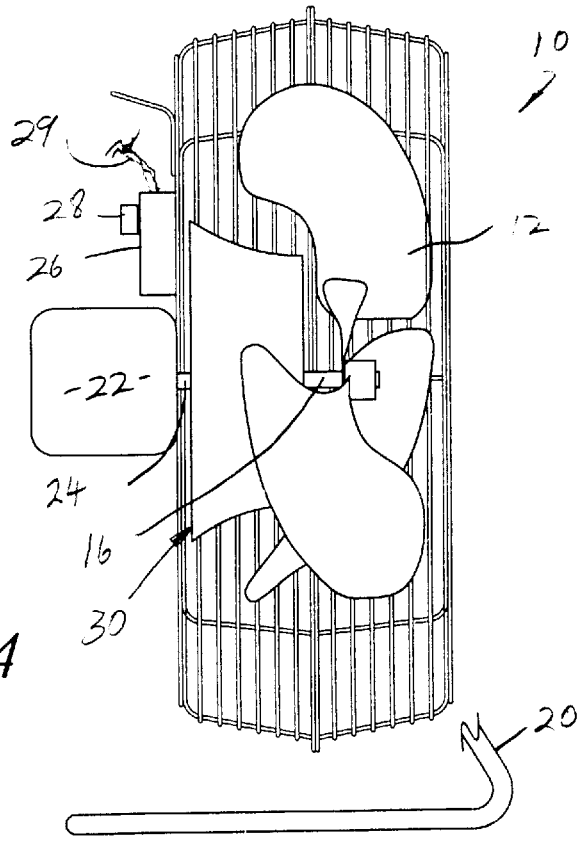
FIG. 4 is a partial cross-sectional view thereof showing the relative size and positioning of the heating assembly and fan blade assembly.
Figure 5:
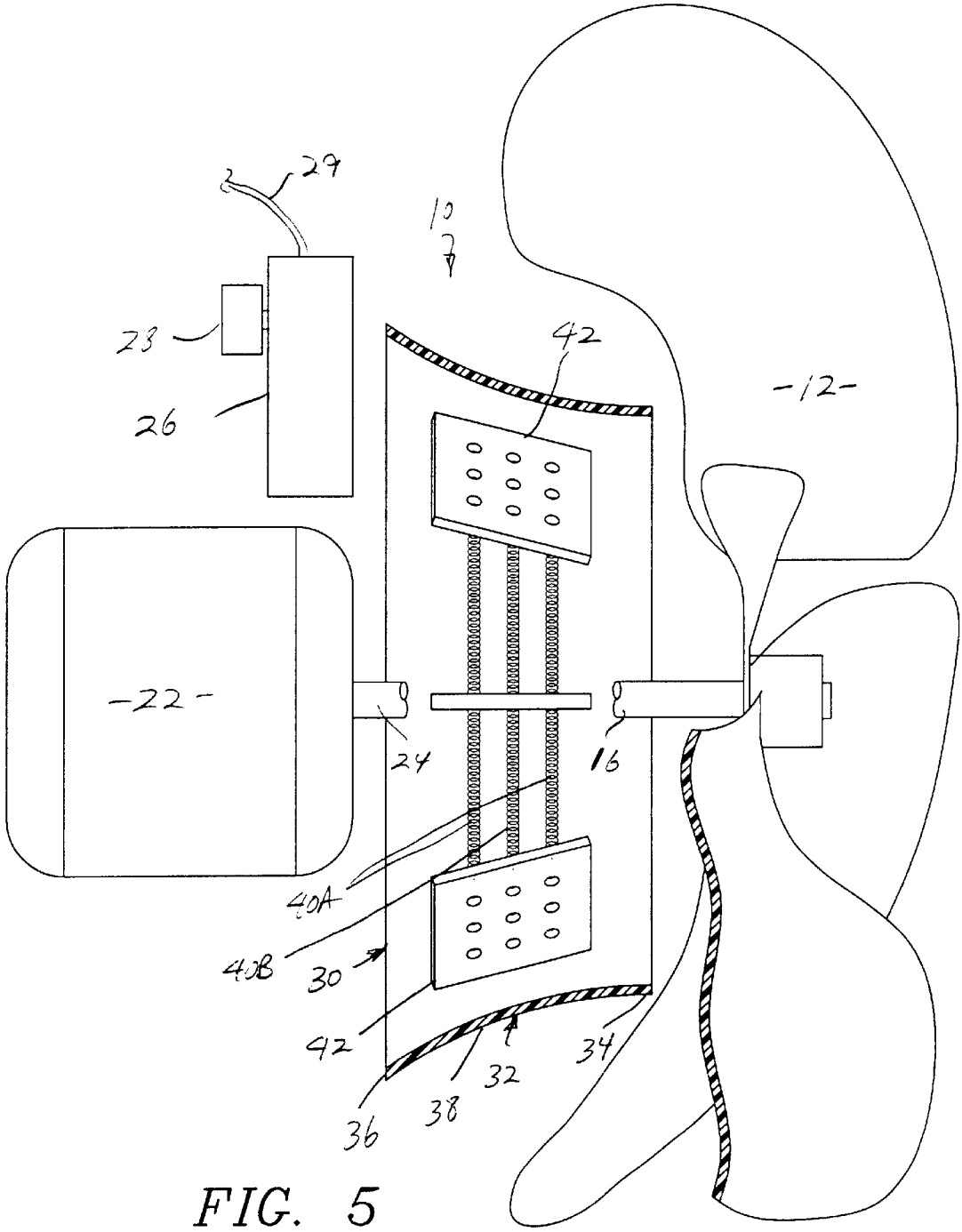
FIG. 5 is a partial cross-sectional view of the heating assembly and fan blade assembly showing the positioning of the resistive heating elements within the heating assembly.
Figure 6:
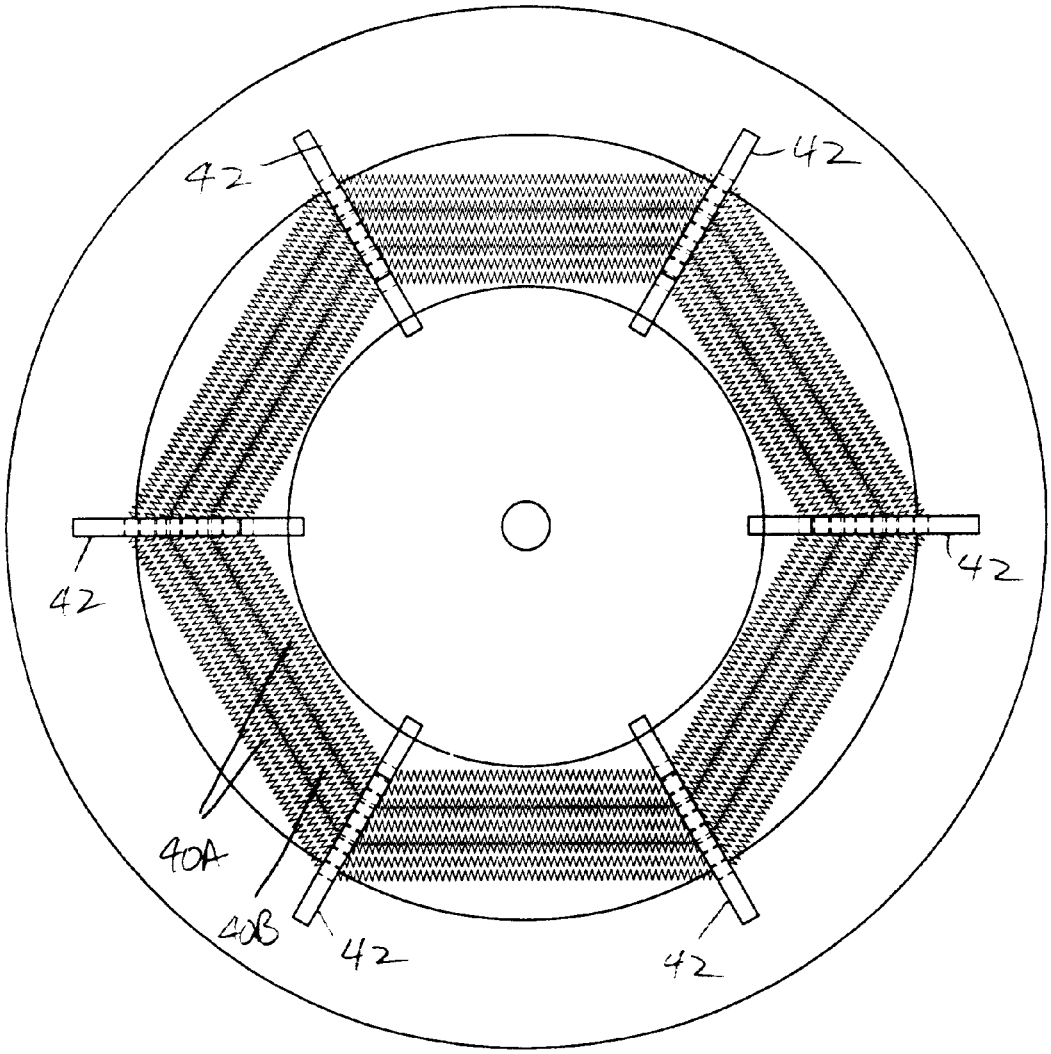
FIG. 6 is a partial front view of the heater assembly showing the resistive heating elements.

As shown in FIGS. 1–5, the combination cooling fan and heater 10 of the invention comprises a fan blade assembly 12 having a plurality of fan blades 14 mounted to a rotatable shaft 16 and positioned within a housing 18 to be supported thereby. The housing 18 preferably comprises a wire cage 18 having a generally cylindrical configuration. The housing 18 is preferably supported in an upright position by a floor or table stand 20. However, it is noted that other configurations of the housings 18 may be employed without departing from the spirit and scope of this invention.

Figures 7, 7A:
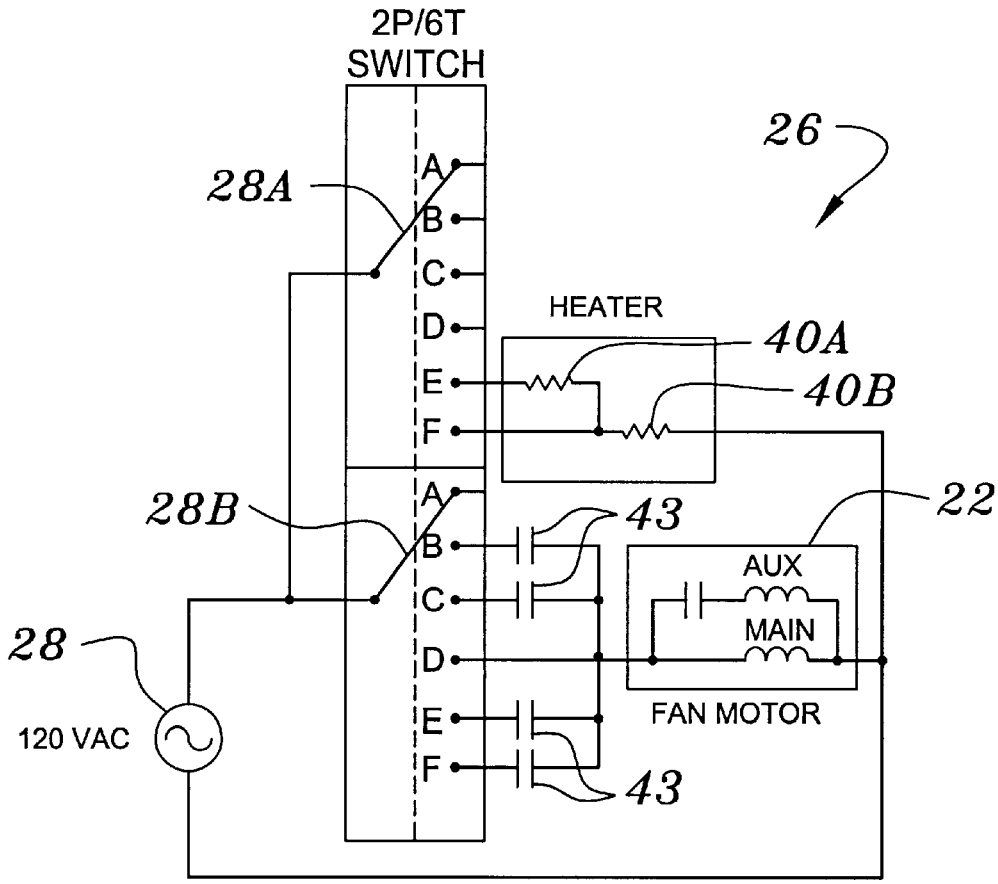
FIG. 7 is a schematic diagram of the fan control and FIG. 7A is a chart listing the heat and speed control positions for the fan control.

An electric motor 22 is preferably positioned exteriorly of the housing and is supported thereby. The electric motor 22 includes a motor shaft 24 extending through the wire cage 18 that is then splined to the rotatable shaft 16 of the fan blade assembly 12. As shown in FIG. 7 a fan control 26 with a switch 28 is provided for controlling the rotational speed of the motor 22 and thus the rotational speed of the fan blade assembly 12. Household electrical current is provided to the electric motor 22 and fan control 26 by means of an electric cord, represented by numeral 29, connected to the input leads of the fan control 26.

A heating assembly 30 is positioned rearwardly of the fan blade assembly 12 within the housing 18 such that a portion of the air flowing through the fan blade assembly 12 flows through the heating assembly 30. The heating assembly 30 preferably comprises a frustroconical baffle 32 defined by a reduced-diameter front portion 34 and an increased diameter rear portion 36. The sides 38 of the baffle 32 may be arcuately-shaped in a venturi configuration. One or more, preferably two, resistive heating elements 40A and 40B are positioned within the frustroconical baffle 32. Each resistive heating element 40A and 40B may comprise a nichrome wire that is heated to a substantial temperature when electrical current flows therethrough. The individual wires of the heating elements 40A and 40B may be secured separated from one another by means of fireproof spacers 42 and may be interleaved with each other to provide low heat when only one is energized or high heat when both are energized. Electrical energy is provided to the resistive heating elements 40A and 40B by wires connected to the source of household electrical current via the switch 28 of the fan control 26 and is controlled thereby.

More particularly, as shown in the schematic diagram of FIG. 7, the switch 28 of the fan control 26 may comprise a double pole 28A and 28B, six-position (A–F) rotary switch 28, with the first pole 28A of the switch 28 controlling the operation of the heating assembly 30 and the second pole 28B controlling the operation of the motor 22. As shown, the resistive heating elements 40A and 40B are connected to respective positions E and F with the first heating element 40A being wired to be connected in series with the second heating element 40B for "low" heat at position E and "high" heat at position F. The second pole 28B is serially connected through respective capacitors or directly to operate the motor 22 at the respective speed positions B, C, E, F, and D as indicated in the chart of FIG. 7A. Preferably, fan speed at position D is the highest (no capacitor). As determined by the increasing respective values of the capacitors 43, the decreasing fan speeds at positions 43C, 43B, 43F and 43E are cooling medium (1 $\mu$f capacitor), cooling low (2 $\mu$f capacitor), high heat (3 $\mu$f capacitor) and low heat (4 $\mu$f capacitor). Thus, as can be appreciated, the switch 26 controls the operation of said heating assembly and the motor to operate at higher speeds when used as a cooling fan and lower speeds when used as a heater.

The size and placement of the heating assembly 30 relative to the size and placement of the fan blade assembly 12 is optimized such that at various motor speeds, sufficient airflow is caused to flow, by reason of the venturi effect, through the heating assembly 30 to produce a heated airflow of various temperatures (i.e., high heat and low heat). Thus. the combination cooling fan and heater 10 of the invention can be used year-round to provide a cooling airflow by turning the switch 28 to one of the cooling positions (B, C or D) with the heating assembly 30 "off" or to provide a high or low heated airflow by turning the switch 28 to one of the heating positions (E or F) with the heating assembly 30 "on" while controlling the speed of the fan blade assembly 12.

Finally, it is noted that appropriate tilt switches (not shown) may be provided to prevent operation of the electric motor 22 and the resistive heating elements 40A and 40B in the event the combined cooling fan and heater 10 tips over. An overheat sensor (not shown) may also be provided in the event the motor 22 ceases to operate to otherwise cool the resistive heating elements 40A and 40B.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described.

What is claimed is:

1. A combination cooling fan and heater, comprising in combination:

a fan blade assembly powered by a motor mounted within a housing;

a heating assembly mounted rearwardly of said fan blade assembly wherein said heating assembly comprises a frustroconical baffle design, operating as a venturi, that is positioned within an airstream produced by said fan blade assembly, and wherein said frustroconical baffle comprises an enlarged diameter portion positioned upstream of said airstream and a reduced diameter portion positioned downstream of said airstream, the enlarged diameter portion having a diameter appreciably less than a diameter of said fan blade assembly such that only part of the airflow produced by said fan blade assembly flows through said heating assembly; and a switch for controlling the operation of said heating assembly and the motor to operate at a higher speed when used as a cooling fan and a lower speed when used as a heater.

2. The combination cooling fan and heater as set forth in claim 1 wherein said switch comprises a speed-control switch for controlling the speed of said motor and thus the speed of said fan blade assembly.

3. The combination cooling fan and heater as set forth in claim 1 wherein said heating assembly comprises at least two resistive heating elements and wherein switch comprises means for connecting electrical power to one or both of said resistive heating elements.

* * * * *